US009981485B2

(12) United States Patent
Ikeda et al.

(10) Patent No.: US 9,981,485 B2
(45) Date of Patent: May 29, 2018

(54) PRINTING METHOD AND PRINTING DEVICE

(71) Applicant: MIMAKI ENGINEERING CO., LTD., Nagano (JP)

(72) Inventors: Akira Ikeda, Nagano (JP); Norikazu Nakamura, Nagano (JP); Moe Ito, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days. days.

(21) Appl. No.: 15/305,655

(22) PCT Filed: Apr. 17, 2015

(86) PCT No.: PCT/JP2015/061889

§ 371 (c)(1),
(2) Date: Oct. 20, 2016

(87) PCT Pub. No.: WO2015/163259

PCT Pub. Date: Oct. 29, 2015

(65) Prior Publication Data

US 2017/0050449 A1 Feb. 23, 2017

(30) Foreign Application Priority Data

Apr. 23, 2014 (JP) ..... 2014-088849
Nov. 6, 2014 (JP) ..... 2014-226133

(51) Int. Cl.
*B41J 2/21* (2006.01)
*B41J 11/00* (2006.01)
*B41M 5/00* (2006.01)

(52) U.S. Cl.
CPC ..... *B41J 11/002* (2013.01); *B41J 2/21* (2013.01); *B41J 2/2114* (2013.01); *B41M 5/00* (2013.01)

(58) Field of Classification Search
CPC ..... B41J 11/002; B41J 2/2114; B41J 2/21; B41M 5/00
See application file for complete search history.

(56) References Cited

U.S. PATENT DOCUMENTS

2003/0149130 A1* 8/2003 Kondo ..... C09D 11/101 523/160
2010/0194838 A1* 8/2010 Mitsuzawa ..... B41J 2/2114 347/102
2012/0287190 A1* 11/2012 Shimada ..... B41J 2/2114 347/12

FOREIGN PATENT DOCUMENTS

JP 2005144679 6/2005
JP 2007268789 10/2007
(Continued)

OTHER PUBLICATIONS

"International Search Report (Form PCT/ISA/210) of PCT/JP2015/061889", dated Jul. 7, 2015, with English translation thereof, pp. 1-4.

*Primary Examiner* — Yaovi M Ameh
(74) *Attorney, Agent, or Firm* — JCIPRNET

(57) ABSTRACT

When an image is printed by inkjet printing on a print surface of a target medium, an overcoat layer is formed in a more appropriate manner. A printing method uses color ink heads 202 as exemplified colored ink heads, a clear ink head 204, and ultraviolet irradiators 206. The printing method includes a color printing step of printing a print image using a colored ink in at least a partial region on a print surface of a medium 50, a non-colored region clear printing step of applying a UV clear ink for printing in a region at least including a non-colored region in which ink droplets are not discharged in the color printing step, and an overcoat layer forming step of forming an overcoat layer that covers the
(Continued)

print image using the UV clear ink in a region covering at least the print image printed in the color printing step.

12 Claims, 7 Drawing Sheets

(56) References Cited

FOREIGN PATENT DOCUMENTS

| | | |
|---|---|---|
| JP | 2008230131 | 10/2008 |
| JP | 2012236356 | 12/2012 |
| JP | 2013146887 | 8/2013 |
| WO | 2010021377 | 2/2010 |

* cited by examiner

PRINTING METHOD AND PRINTING DEVICE

CROSS-REFERENCE TO RELATED APPLICATION

This application is a 371 of international application of PCT application serial no. PCT/JP2015/061889, filed on Apr. 17, 2015, which claims the priority benefits of Japan application no. 2014-088849, filed on Apr. 23, 2014 and Japan application no. 2014-226133, filed on Nov. 6, 2014. The entirety of each of the above mentioned patent applications is hereby incorporated by reference herein and made a part of this specification.

TECHNICAL FIELD

This invention relates to a printing method and a printing device.

BACKGROUND ART

Conventionally, ink jet printers are used in a broad range of industrial and technical fields (for example, Patent Literature 1). Inks most typically used in the ink jet printers are inks of ultraviolet curing type curable by being irradiated with ultraviolet light.

CITATION LIST

Patent Literature

Patent Literature 1: Japanese Unexamined Patent Publication No 2005-144679

SUMMARY OF INVENTION

Technical Problems

In a printing operation using an ink jet printer, an overcoat layer may be additionally formed for protection of a printed image to improve weather resistance and glossiness of a printed matter. The overcoat layer for this purpose may be formed by printing using a transparent clear ink.

The overcoat layer, however, may have an uneven surface under certain printing conditions, degrading the quality of a printed matter. The overcoat layer unevenly formed may produce transverse streaks. The transverse streaks may refer to patterns running in the form of streaks in a direction in which an inkjet head moves during main scans. The unevenness of the overcoat layer may incur the problems of cracks and air bubbles. The cured clear ink may undergo striped patterns (curing streaks), which may impair the glossiness of the clear ink layer. The striped patterns may appear in the form of streaks at interfacial positions between target regions of main scans (main scan regions).

Therefore, more appropriate methods of forming the overcoat layer have so far been pursued to deal with this issue. This invention provides a printing device and a printing method that may overcome this issue.

Solutions to Problems

The inventors of this application were committed to the search of factors leading to unevenness of the overcoat layer, and they found out the fact described below. When, for example, an image is rendered with a colored ink and later coated with the overcoat layer, the print surface of a target medium may have irregularity resulting from the applied colored ink. Then, the clear ink may not be equally spread on the print surface. This was found to be the causation of such undesired unevenness of the overcoat layer.

More specifically, for example, when a colored ink of ultraviolet curing type is used for image printing, dots of the colored ink are formed in part of the print surface to print an image. This means that the print surface have different regions; colored ink-applied region and colored ink-unapplied region. The colored ink-applied region refers to a region in which the colored ink dots are formed. The colored ink-unapplied region refers to a region in which the medium surface is uncoated with the colored ink and exposed. This may generate irregularity substantially equal to the ink layer thickness between the colored ink-applied region and colored ink-unapplied region.

In case the overcoat layer is made of a UV clear ink; clear ink of ultraviolet curing type, the applied UV clear ink is conventionally cured after the ink dots on the medium become fiat enough. After the ink droplets of the UV clear ink are landed on the medium, therefore, a certain amount of waiting time should be invested before ultraviolet irradiation starts.

If the base of the region to be coated with the overcoat layer has irregularity, however, the UV clear ink possibly flows out before being irradiated with ultraviolet light and thereby unequally spread. Thus, the UV clear ink may not be equally spread in case the base has such irregularity due to the colored ink applied thereon. This may undesirably cause the cured overcoat layer to be uneven.

To address this issue, the inventors of this application came up with the idea of applying the UV clear ink in the colored ink-unapplied region, instead of leaving the medium surface exposed. Thus, a configuration having the colored ink-unapplied region filled with the UV clear ink can be expected to suppress appropriately irregularity between the colored ink-applied region and the colored ink-unapplied region. By forming the overcoat layer on the surface thus improved in smoothness, the cured overcoat layer may be suppressed from forming unevenness. The inventors of this application confirmed through tests that the described effect was certainly obtainable. To address the conventional issue, this invention provides for the structural and technical aspects hereinafter described.

[Aspect 1] A printing method is provided that carries out an inkjet printing operation for a print surface of a medium as a print target. The printing method uses a colored ink head as an inkjet head that discharges ink droplets of a colored ink of ultraviolet curing type; a clear ink head as an inkjet head that discharges ink droplets of a UV clear ink of ultraviolet curing type having a clear color; and an ultraviolet irradiator that emits ultraviolet light. The printing method includes: a color printing step of having the colored ink head discharge the ink droplets to at least a partial region on the print surface of the medium based on a print image as an image to be printed and having the ultraviolet irradiator emit ultraviolet light to the partial region to print the print image using the colored ink; a non-colored region clear printing step of having the clear ink head discharge the ink droplets and having the ultraviolet irradiator emit ultraviolet light to apply the UV clear ink to a region at least including a non-colored region on the print surface of the medium, the non-colored region being a region in which the ink droplets are not discharged in the color printing step; and an overcoat layer forming step that follows the non-colored region clear printing step, the overcoat layer forming step being a step of having the clear ink head discharge the ink droplets to a region covering at least the print image printed in the color printing step and having the ultraviolet irradiator emit ultraviolet light to the region to form an overcoat layer that covers the print image using the UV clear ink.

According to this method, any colored ink-unapplied region on the print surface of the medium may be adequately filled with the UV clear ink. In this method, the medium surface may be leveled out by controlling the ink layer thickness. This may effectively suppress irregularity between the colored ink-applied region and the colored ink-unapplied region. By forming the overcoat layer on the surface thus improved in smoothness, the cured overcoat layer may be suppressed from forming unevenness. This configuration may successfully prevent such degraded printing quality due to unevenness of the overcoat layer. As a result, the overcoat layer may be formed in a more appropriate manner.

The overcoat layer may not only be formed to protect the print image, but may also cover the whole or a partial layer of the UV clear ink formed in the non-colored region clear printing step. This printing method may be conceived as a manufacturing method for printed matter.

As described earlier, the UV clear ink is applied in the non-colored region clear printing step to a region at least including the non-colored region in which the ink droplets are not discharged in the color printing step. This may mean that, among preset print target regions on the print surface of the medium, the UV clear ink is selectively applied to a region at least including the non-colored region in which the ink droplets are not discharged in the color printing step. The non-colored region refers to a region, among the print target regions, in which the colored ink droplets that form the print image are not discharged. Covering the print image with the UV clear ink in the overcoat layer forming step may mean coating a region to be protected of the print image with the UV clear ink, thereby forming the overcoat layer. When, for example, the overcoat layer is intentionally not formed in a part of the print image, covering the print image with the UV clear ink may mean coating any parts of the print image but intentionally ruled-out parts of the print image with the UV clear ink.

[Aspect 2] In the overcoat layer forming step, a region preconfigured to cover at least the print image is painted out with the UV clear ink. Having a preconfigured region painted out with the UV clear ink is specifically discharging the ink droplets at a uniform concentration to the whole preconfigured region. According to this configuration, the overcoat layer may be more favorably formed.

[Aspect 3] The UV clear ink is cured matte in the non-colored region clear printing step, and the UV clear ink is cured glossy in the overcoat layer forming step. This may more effectively suppress irregularity between the colored ink-applied region and the colored ink-unapplied region. Then, the overcoat layer may be even more favorably formed.

Matte curing of the ink is more specifically curing the ink dots before they are flattened. By irradiating the ink droplets with ultraviolet light immediately after they landed on the medium, the ink dots may be curable before they are flattened. When, for example, the inkjet head is prompted to perform a main scan, the ultraviolet irradiator may be disposed at a position adjacent to the inkjet head in a main scanning direction to irradiate the ink droplets with ultraviolet light during the main scan.

Glossy curing of the ink is more specifically curing the ink dots after they are flattened. After the ink droplets are landed on the medium, waiting time may be invested for the ink dots to be flattened before being irradiated with ultraviolet light. More specifically, the inkjet head, when prompted to perform main scans, may perform the main scans in respective regions on the medium without the emission of ultraviolet light, in which case ultraviolet starts to be emitted when the main scans for each region are over. The emission of ultraviolet irradiation may be enabled by having the ultraviolet irradiator scan the regions on the medium at different timings to the main scans by the inkjet head. The ultraviolet may start to be emitted from the ultraviolet irradiator only after the main scans for the whole medium are completed.

[Aspect 4] The colored ink head and the clear ink head perform a main scan and a sub scan in the inkjet printing operation for the medium, the main scan being a scan in which the colored ink head and the clear ink head, while moving in a predetermined main scanning direction, discharge the ink droplets, the sub scan being a scan in which the colored ink head and the clear ink head move relative to the medium in a sub scanning direction orthogonal to the main scanning direction. The main scan by the colored ink head in the color printing step and the main scan by the clear ink head in the non-colored region clear printing step proceed in parallel.

This may efficiently expedite the color printing step and the non-colored region clear printing step. This may also achieve reduction of time required to form the overcoat layer, enabling high-speed printing.

[Aspect 5] In the non-colored region clear printing step, the ink droplets are discharged from the clear ink head based on a gray-scaled and gradation-inverted image of the print image. Discharging the ink droplets from the clear ink head based on the gray-scaled and gradation-inverted print image may be rephrased as printing this image using the UV clear ink.

In case the print image is a photograph, the print image may have gradations that differ at different positions. Specifically, assuming that the print image is a subject's photograph having black and white portions, these parts greatly differ from each other in gradation. When the print image is printed by inkjet printing, the ink deposited on the medium may be variable in thickness due to the different gradations. Then, the thickness of an ink layer within the print image is possibly variable due to the different gradations. Such gradation-associated variability in thickness within the print image possibly causes the overcoat layer to be uneven.

When the ink droplets are discharged from the clear ink head based on the gray-scaled and gradation-inverted print image, the UV clear ink may be discharged in greater amounts for parts having brighter gradations at any positions overlapping with the print image. On the other hand, the UV clear ink is discharged in smaller amounts for parts having darker gradations within the print image.

According to the aspect described earlier, the UV clear ink may be applied in the non-colored region clear printing step in a manner suited to the distribution of gradations within the print image. The operation in the color printing step alone possibly fails to avoid the thickness variability due to the different gradations within the print image. Yet, irregularity resulting from such thickness variability may be effectively suppressed by combining the operation with the operation in the non-colored region clear printing step. As a result, the overcoat layer may be formed in a more appropriate manner.

[Aspect 6] The method further includes a matte clear printing step subsequent to the non-colored region clear printing step. In the matte clear printing step, a region covering at least the print image printed in the color printing step is painted out with the UV clear ink, and the UV clear is cured matte. In the overcoat layer forming step, the overcoat layer is formed on the UV clear ink cured matte in the matte clear printing step.

In case the overcoat layer forming step immediately follows the non-colored region clear printing step, with the matte clear printing step having been skipped, the base of the overcoat layer includes the colored ink layer formed in the color printing step and the UV clear ink layer formed in the non-colored region clear printing step. The colored ink and the UV clear ink respectively have different properties. Such differences in properties may differently affect a relationship between the overcoat layer and its base depending on positions.

For example, the colored ink contains a coloring material such as pigment, whereas the UV clear ink contains no coloring material. Spreading the UV clear ink containing no coloring material on the pigment-containing colored ink may produce different impacts on the UV clear ink. For example, repellency against the UV clear ink may be mentioned. The repellency against the UV clear ink that differs at different positions may result in the failure to equally spread the UV clear ink.

According to the aspect described earlier, the UV clear ink layer is cured matte in the matte clear printing step as the base of the overcoat layer. This may provide the base of the overcoat layer improved in uniformness. The overcoat layer may be accordingly even more favorably formed.

Depending on the properties of inks to be used and/or demanded printing quality, the matte clear printing step may be unnecessary to form the overcoat layer. Then, the matte clear printing step may be skipped, in which case the overcoat layer forming step immediately follows the non-colored region clear printing step.

[Aspect 7] In the matte clear printing step, a first region that covers at least the print image is painted out with the UV clear ink. In the overcoat layer forming step, a second region narrower than the first region and having an edge part located within the first region is painted out with the UV clear ink. The second region may be slightly thinner in its edge part than the first region.

After a certain region is painted out with an ink of ultraviolet curing type, an edge part of the region may be slightly swollen after being cured. When the matte UV clear ink layer is formed in the matte clear printing step, for example, the relevant region may likewise have an edge part slightly swollen.

When the overcoat layer is formed in exactly the same region as the matte UV clear ink layer, their overlapping edge parts may be further swollen. This may more adversely affect the overcoat layer. Specifically, the UV clear ink layer may increase in thickness in its edge part, easily undergoing cracks. According to the aspect described earlier, the overcoat layer is formed in the second region narrower than the first region to prevent overlap between the edge parts of these layers. This may effectively prevent the edge parts from overly swelling. As a result, the overcoat layer may be formed in a more appropriate manner.

[Aspect 8] The medium is a plastic card. The plastic card may be an inflexible plastic card. The plastic card may be a medium for an ID card with a photograph. In case of such an ID card, a person's photograph is printed as the print image.

When such a flat plastic card is used as the medium, irregularity substantially equal to the ink layer thickness, if generated on its flat surface, may be even more noticeable. This may involve the risk of the uncured UV clear ink flowing out at the time of forming the overcoat layer. When a plastic card is used as the medium, such irregularity may increase repellency of any thinner ink-printed parts against the UV clear ink, possibly leaving puddles of the UV clear ink.

The printing method disclosed herein, however, may more effectively suppress irregularity between the colored ink-applied region and the colored ink-unapplied region. This printing method may form the overcoat layer in a more appropriate manner when plastic cards are used as the medium.

[Aspect 9] A printing method is provided that carries out an inkjet printing operation for a print surface of a medium as a print target. The printing method uses a colored ink head as an inkjet head that discharges ink droplets of a colored ink of ultraviolet curing type; a clear ink head as an inkjet head that discharges ink droplets of a UV clear ink of ultraviolet curing type having a clear color; a predetermined color ink head as an inkjet head that discharges ink droplets of a predetermined color ink of ultraviolet curing type having a predetermined color; and an ultraviolet irradiator that emits ultraviolet light. The printing method includes: a predetermined color printing step of having the predetermined color ink head discharge the ink droplets to at least a partial region on the print surface of the medium and having the ultraviolet irradiator emit ultraviolet light to the partial region; a color printing step of having the colored ink head discharge the ink droplets to at least a partial region on the print surface of the medium based on a print image as an image to be printed and having the ultraviolet irradiator emit ultraviolet light to the partial region to print the print image using the colored ink; and an overcoat layer forming step of having the clear ink head discharge the ink droplets to a region covering at least the print image printed in the color printing step and having the ultraviolet irradiator emit ultraviolet light to the region to form an overcoat layer that covers the print image using the UV clear ink, the predetermined color printing step further being a step of applying the predetermined color ink to a region at least including a non-colored region on the print surface of the medium, the non-colored region being a region in which the ink droplets are not discharged in the color printing step.

The inventors of this application, through their keen studies and researches, found out that other inks, instead of the UV clear inks, could effectively be used to prevent irregularity between the colored ink-applied region and the non-colored region. Specifically, when an ink of a predetermined color (predetermined color ink) is applied to the non-colored region, instead of the UV clear ink, to fill the non-colored region with a predetermined color ink, such irregularity between the regions may be accordingly suppressed. The method according to this aspect may produce useful effects similar to the aspect 1.

The predetermined color ink may be an ink of a predetermined single color (for example, white). A suitable example of the predetermined color ink may be an ink having a color that constitutes the background of the print image. The predetermined color ink may be of the same color as the print surface of the medium.

[Aspect 10] The predetermined color ink is applied in the predetermined color printing step prior to the color printing step. According to this method, any colored ink-unapplied region on the print surface of the medium may be favorably filled with the predetermined color ink.

When the UV clear ink is used to fill the non-colored region and ink droplets of this ink are discharged to the non-colored region after the color printing step, this transparent ink may not affect the visibility of the print image. When the predetermined color ink is used instead of the UV clear ink, ink droplets of this ink, if discharged to the non-colored region later than the color printing step, may be applied on the print image, possibly impairing the visibility of the print image. This may degrade the quality of the print image.

Having the predetermined color printing step precede the color printing step may effectively prevent the predetermined color ink from degrading the quality of the print image. The overcoat layer may be accordingly even more favorably formed.

[Aspect 11] The predetermined color ink is a white ink. The white ink, when used as the predetermined color ink, may adequately fill the non-colored region with the predetermined color ink without unnecessarily coloring the peripheral region of the print image. The overcoat layer may be accordingly even more favorably formed.

Other than the above-described matters, the operations described in the aspects 9 to 11 may be carried out identically or similarly to the operations described in the aspects 1 to 8. For example, the medium may be a plastic card. The operations in the color printing step and the overcoat layer forming step may be carried out identically or similarly to the operations described the aspects 1 to 8. Specifically, in the overcoat layer forming step, the region preconfigured to cover at least the print image may be painted out with the UV clear ink. Further, the UV clear ink may be cured glossy in the overcoat layer forming step.

Details of the operation in the predetermined color printing step may be identical or similar to the operations in the non-colored region clear printing step described in the aspects 1 to 8. In the predetermined color printing step, the predetermined color ink may be cured matte. In the predetermined color printing step, the ink droplets may be discharged from the predetermined color ink head based on a gray-scaled and gradation-inverted image of the print image.

For example, the matte clear printing step identical or similar to the aspects 6 and 7 may follow the predetermined color printing step and the color printing step. In that case, the overcoat layer may be formed in the overcoat layer forming step on the matte UV clear ink layer formed in the matte clear printing step. In the matte clear printing step, the first region covering at least the print image may be painted out with the UV clear ink. In the overcoat layer forming step, the second region narrower than the first region and having an edge part located within the first region may be painted out with the UV clear ink. By having inkjet heads perform main scans to print an object, for example, main scans performed respectively by the predetermined color ink head in the predetermined color printing step and by the clear ink head in the non-colored region clear printing step may be performed in parallel.

[Aspect 12] A printing device that performs an inkjet printing operation using the printing method described in any one of the aspects 1 to 11. The printing device thus characterized may produce useful effects similar to the aspects 1 to 11.

Effect of Invention

As thus far described in this invention, the overcoat layer may be formed in a more appropriate manner when an image is printed by inkjet printing on the print surface of a print target medium.

BRIEF DESCRIPTION OF DRAWINGS

FIG. 1A is a drawing of the printing device 10, illustrating its main structural elements by way of example. FIG. 1B is a drawing, specifically illustrating a head unit 12.

FIG. 3A shows a print image used in the color printing step. FIG. 3B shows an inverted, gray-scaled image used in the non-colored region clear printing step. FIG. 3C shows an image used in the overcoat layer forming step.

FIG. 4A is a flow chart of a printing operation according to the modified embodiment. FIG. 4B shows an image used in a matte clear printing step.

FIG. 5A is a drawing of a modified example of the head unit 12. FIG. 5B shows a modified example of the image used in the non-colored region clear printing step.

FIG. 6A is a drawing of an example of the head unit 12. FIG. 6B is a drawing of another example of the head unit 12.

DESCRIPTION OF EMBODIMENTS

Figure 1A:
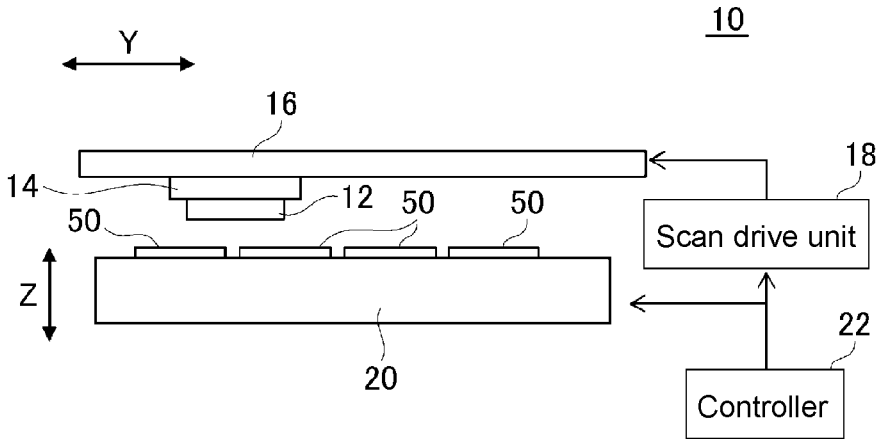
FIG. 1A and 1B are drawings of an exemplified printing device 10 for exercising a printing method according to an embodiment of this invention.
Figure 1B:
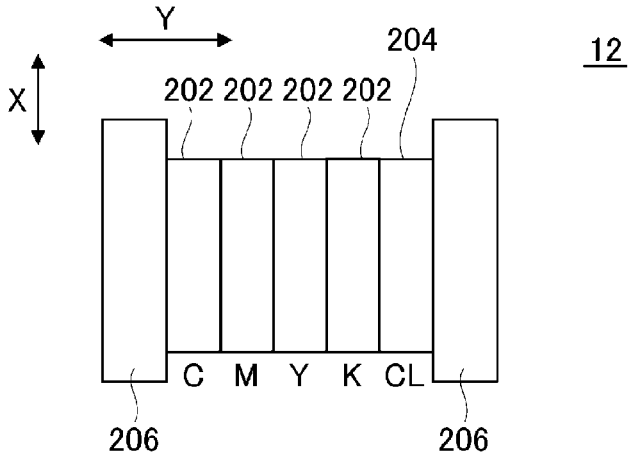

Hereinafter, embodiments of this invention are described in detail with reference to the accompanying drawings. FIG. 1A and 1B are drawings of an exemplified printing device 10 for a printing method according to an embodiment of this invention. FIG. 1A is a drawing of the printing device 10, illustrating its main structural elements by way of example. Except for the technical features hereinafter described, the printing device 10 may be configured identically or similarly to the known ink jet printers. Specifically, the printing device 10 may be suitably selected from ink jet printers of UJF models supplied by MIMAKI ENGINEERING CO., LTD. The ink jet printers of UJF series supplied by MIMAKI ENGINEERING CO., LTD include ink jet printers of UJF-3042 models (for example, UJF-3042FX, UJF-3042HG), and ink jet printers of UJF-6042 models.

The printing device 10 is an inkjet printer of serial printing type in which inkjet heads perform main scans (scanning operation). The printing device 10 may preferably be a multipass inkjet printer. The multipass may refer to a printing technique in which main scans are plurally performed at each position in a region to be printed of a target medium 50 to print an object thereon. In this embodiment, the printing device 10 is an inkjet printer (UV printer) that prints an object by inkjet printing on the medium 50 using inks of ultraviolet curing type. The printing device 10 has a head unit 12, a carriage 14, a guide rail 16, a scan drive unit 18, a table 20, and a controller 22.

The head unit 12 discharges ink droplets to the medium 50 to print an object thereon. In this embodiment, the head unit 12 has a plurality of inkjet heads. The inkjet heads, as prompted by instructions of the controller 22, form ink dots corresponding to pixels of an image to be printed on the medium 50. The head unit 12 will be described later in further detail.

The carriage 14 is a member that holds the head unit 12 so as to face the medium 50. The guide rail 16 guides the movement of the carriage 14 in a main scanning direction. The scan drive unit 18 prompts the head unit 12 to perform main scans and sub scans.

Prompting the head unit 12 to perform main and sub scans technically means prompting the inkjet heads of the head unit 12 to perform main scans and sub scans. By prompting the inkjet heads to perform the main scans, the inkjet heads, while moving in a predetermined main scanning direction (Y direction in the drawing), discharge the ink droplets to the medium 50. During the main scan, the scan drive unit 18 moves the carriage 14 along the guide rail 16 and thereby moves the head unit 12 in the Y direction.

By prompting the inkjet heads to perform the sub scans, the inkjet heads move relative to the medium 50 in a sub scanning direction (X direction) orthogonal to the main scanning direction. This X direction refers to a direction orthogonal to the Y direction and Z direction illustrated in the drawing. During the sub scans, the scan drive unit 18 moves the guide rail 16 in the X direction and thereby moves the head unit 12 in the X direction.

The printing device 10 may be configured to move the medium 50 during the sub scans, with the position of the head unit 12 being fixed in the sub scanning direction. In the printing device 10 thus configured, the sub scans may be performed by moving the table 20 supporting the medium 50.

The table 20 is a member to be mounted with the medium 50. The table 20 supports the medium 50 so as to face the head unit 12. In this embodiment, the table 20 is operable to move its upper surface upward and downward in a predetermined vertical direction (Z direction in the drawing). This vertical direction refers to a direction that connects the head unit 12 and the medium 50 facing each other. In the printing device thus configured, a broad range of media 50 may be usable, and a distance between the head unit 12 and the medium 50 may be suitably adjusted in accordance with the thickness of any one of the media 50 selected and used.

In this embodiment, the table 20 can hold a plurality of media 50 on its upper surface next to one another. Then, the plural media 50 may be subjected to the printing operation at once. The table 20 may include a holder for holding the medium 50. The holder may be a jig formed in a shape corresponding to the medium 50.

The controller 22 may be the CPU of the printing device 10, for example. The controller 22 controls the operations of the structural elements of the printing device 10 as prompted by instructions outputted from a host PC. The printing device 10 thus configured carries out the printing operation for the medium 50.

The head unit 12 is now more specifically described. FIG. 1B is a drawing, specifically illustrating the head unit 12.

In this embodiment, the head unit 12 has a plurality of color ink heads 202 as an example of the colored ink head disclosed herein. The head unit 12 further has a clear ink head 204 and a plurality of ultraviolet irradiators 206. The colored ink head may be an inkjet head that discharges ink droplets of a colored ink of ultraviolet curing type. In this embodiment, the color ink heads 202 discharge ink droplets of C, M, Y, and K color inks of ultraviolet curing type, respectively. The C, M, Y, and K color inks are presented by way of example of the colored ink.

The color ink heads 202 may be selected from any suitable ones of the known inkjet heads. Though not illustrated in the drawing, each of the color ink heads 202 may have a nozzle array in which a plurality of nozzles are arranged in the sub scanning direction (X direction). The color ink heads 202 are arranged next to one another in the main scanning direction in positional alignment with one another in the sub scanning direction.

The clear ink head 204 is an inkjet head that discharges ink droplets of a UV clear ink of ultraviolet curing type having a clear color. The clear color may refer to a colorless, transparent color. The clear color ink may be an ink containing no coloring agent such as pigment. The clear color ink may be an ink used to form an overcoat layer serving as the protective layer of a printed matter.

The clear ink head 204 may be selected from any suitable ones of the known inkjet heads. Though not illustrated in the drawing, the clear ink head 204 may have a nozzle array in which a plurality of nozzles are arranged in the sub scanning direction. The clear ink head 204 is disposed next to the color ink heads 202 in the main scanning direction in positional alignment with the color ink heads 202 in the sub scanning direction.

The ultraviolet irradiators 206 are light sources that emit ultraviolet light to cure the inks of ultraviolet curing type. A suitable example of the ultraviolet irradiator 206 may be a light source having UVLED. In this embodiment, the ultraviolet irradiators 206 are respectively disposed on one end side and the other end side in the main scanning direction of the arrangement of the color ink heads 202 and the clear ink head 204.

In a modified embodiment, the printing device 10 may have a head unit 12 different from the head unit 12 illustrated in FIG. 1B. For convenience of illustration, all of the inkjet heads (color ink heads 202 and clear ink head 204) illustrated in FIG. 1B are arranged in the main scanning direction in positional alignment with one another in the sub scanning direction. In a different example of the head unit 12, one or more of the inkjet heads may be arranged with their positions displaced from the positions of other inkjet heads in the sub scanning direction. For example, the clear ink head 204 may be positionally displaced from the color ink heads 202 in the sub scanning direction.

Each of the color ink heads 202 and the clear ink head 204 may be an inkjet head having a plurality of inkjet heads combined. Each of the color ink heads 202 and the clear ink head 204 may be a staggered head having a plurality of inkjet heads disposed in staggered arrangement.

Figure 2:
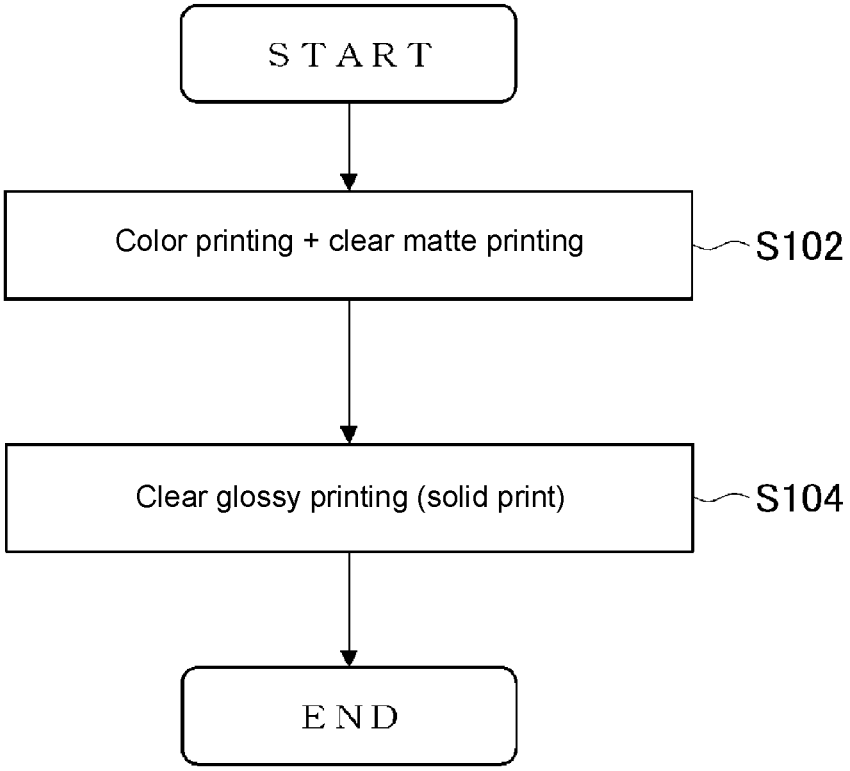
FIG. 2 is a flow chart of the printing operation according to the embodiment.

Next, the printing operation by the printing device 10 (printing method) is hereinafter described in further detail. FIG. 2 is a flow chart of the printing operation according to the embodiment. The printing operation in this embodiment is inkjet printing of an object on the print surface of the target medium 50. An example of the medium 50 is a plastic card.

Specifically, the printing operation in this embodiment includes color printing using the C, M, Y, and K inks, and clear matte printing for matte printing of the UV clear ink (Step S102). Step S102 is an exemplified step including the color printing step and the non-colored region clear printing step.

The color printing step is a step of having the color ink heads 202 discharge the ink droplets to at least a partial region on the print surface of the medium 50 and having the ultraviolet irradiators 206 emit ultraviolet light to the partial region. In this embodiment, the ink droplets are discharged from the color ink heads 202 in the color printing step based on a print image as an image to be printed. Then, the print image is printed with the C, M, Y, and K inks.

Discharging the ink droplets from the color ink heads 202 based on the print image technically means, for example, discharging the ink droplets so as to draw the predetermined print image on the medium 50. At the time, the ink droplets may be discharged in accordance with a RIP-processed image of the print image. In the color printing step according to this embodiment, the color ink heads 202 perform the main scans, with ultraviolet light being emitted from the ultraviolet irradiators 206.

In the non-colored region clear printing step, the UV clear ink is applied to at least a non-colored region on the print surface of the medium 50. The non-colored region may refer to a region in which the ink droplets are not discharged in the color printing step. In the non-colored region clear printing step, for example, the ink droplets are discharged from the clear ink head 204 to the non-colored region, and the non-colored region is then irradiated with ultraviolet light emitted from the ultraviolet irradiators 206.

More specifically, in the non-colored region clear printing step of this embodiment, the ink droplets are discharged from the clear ink head 204 based on a gray-scaled and gradation-inverted image of the print image (hereinafter, referred to as inverted, gray-scaled image). By discharging the ink droplets from the clear ink head 204 based on the inverted, gray-scaled image, the inverted, gray-scaled image is printed with the UV clear ink.

As said earlier, Step S102 exercises the clear matte printing using the UV clear ink. The clear matte printing using the UV clear ink technically means that matte curing of the UV clear ink is exercised in the non-colored region clear printing step. The matte curing of the UV clear ink is specifically irradiating the ink droplets that are just landed on the medium 50 with ultraviolet light to cure the ink dots before they are flattened. More specifically, in case of using the head unit 12 described referring to FIG. 1B, the matte curing is more specifically having the clear ink head 204 perform the main scans, with ultraviolet light being emitted from the ultraviolet irradiators 206.

In this embodiment, the UV clear ink is applied based on the inverted, gray-scaled image. In the non-colored region clear printing step, therefore, the ink droplets of the UV clear ink may be discharged to any region overlapping with the print image as well as the non-colored region. A bright region of the print image is a dark region of the inverted, gray-scaled image. When applying the UV clear ink based on the inverted, gray-scaled image, the dark region requires more ink droplets to be discharged. This means that the ink droplets of the UV clear ink may be discharged at positions on the medium 50 corresponding to the bright region of the print image.

In the non-colored region clear printing step of this embodiment, the UV clear ink is applied to at least the non-colored region. The discharge of the UV clear ink, however, may not necessarily be limited to the non-colored region alone but may also include the use of such an inverted, gray-scaled image. More specifically, for example, the UV clear ink may be applied to positions overlapping with the print image depending on brightnesses in respective parts of the print image. Detailed description will be given later to specific examples of the print image and the inverted, gray-scaled image, and reasons why the inverted, gray-scaled age is preferably used.

In the printing operation of this embodiment, subsequent to Step S102, clear glossy printing, i.e., glossy printing of the UV clear ink, is exercised (Step S104). Step S104 is an exemplified step including the overcoat layer forming step. In this step, the overcoat layer that covers the print image is formed with UV clear ink by the clear glossy printing of solid print type for the whole surface of the medium 50. The overcoat layer forming step is a step of having the clear ink head 204 discharge the ink droplets to a region covering at least the print image printed in the color printing step and having the ultraviolet irradiators 206 emit ultraviolet light to the region. In the overcoat layer forming step of this embodiment, glossy curing of the UV clear ink is exercised by shifting timings of the operation in the non-colored region clear printing step and the emission of ultraviolet light in Step S102. The glossy curing of the UV clear ink is exercised by irradiating the ink dots with ultraviolet light after the passage of waiting time long enough to flatten dots of the UV clear ink droplets that are landed on the medium 50. More specifically describing the glossy curing in case of using the head unit 12 described referring to FIG. 1B, the clear ink head 204 perform the main scans for the respective regions on the medium 50 without the emission of ultraviolet light, and the regions are each irradiated with ultraviolet light afterwards.

The overcoat layer forming step may be a step in which a region preconfigured to cover at least the print image is painted out with the UV clear ink. To paint out a preconfigured region using the UV clear ink, the ink droplets are discharged at a uniform concentration to the whole preconfigured region. More specifically, to paint out a particular region using the UV clear ink, the printing device may be preconfigured for solid print.

The solid print may mean applying the ink for printing at the concentration of 100% previously set in the printing device. To paint out the region in the overcoat layer forming step, the printing operation may be carried out at the concentration greater than 100%, for example, 200% or 300%. The concentration of 200% or 300% means that, in the overcoat layer forming step, the main scan for discharging the UV clear ink is performed twice or three times at the concentration of 100% for each region of the medium 50.

When the main scans are plurally performed for the respective regions in the overcoat layer forming step, the respective regions may be irradiated with ultraviolet light in the overcoat layer forming step after the plural main scans are over. Then, the ink dots forming the overcoat layer may be more adequately flattened.

As described, the printing operation of this embodiment includes the color printing step, non-colored region clear printing step, and overcoat layer forming step. The operations in the color printing step, non-colored region clear printing step, and overcoat layer forming step are hereinafter described in further detail referring to specific examples of the print image and inverted, gray-scaled image.

Figure 3A:
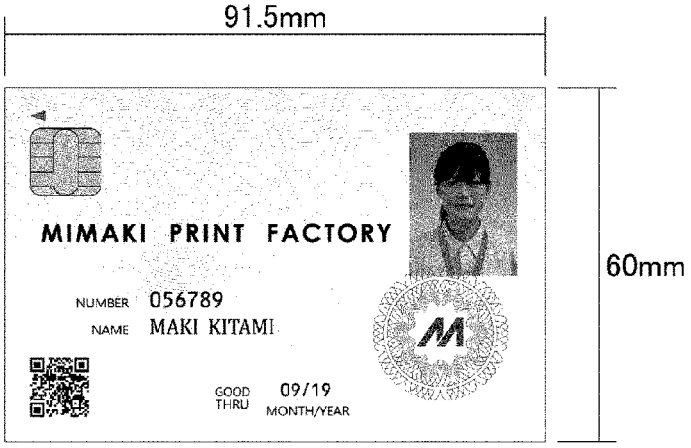
FIG. 3A to 3C are drawings respectively showing exemplified images used in the printing operation in a color printing step, a non-colored region clear printing step, and an overcoat layer forming step.
Figure 3B:
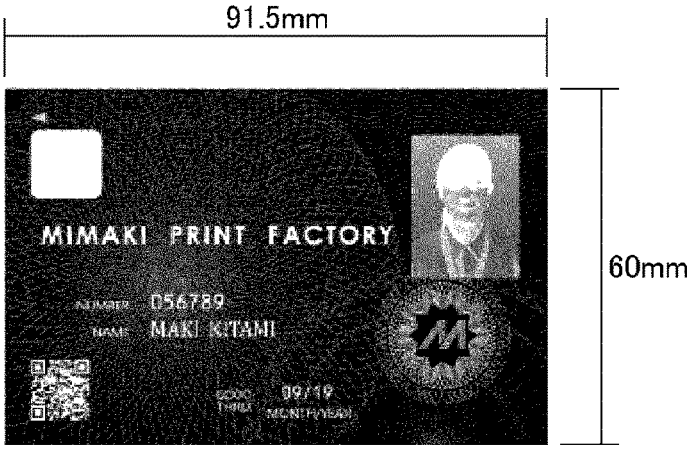

FIG. 3A and 3B respectively show exemplified images used for printing in the color printing step, non-colored region clear printing step, and overcoat layer forming step. In a printing operation hereinafter described (referred to as "this example"), the medium 50 is a plastic card of 86 mm×54 mm in actual size. The plastic card may be an inflexible plastic card. More specifically, the plastic card may be, for example, an ID card with a photograph, or an IC chip-embedded ID card. Through the color printing step, non-colored region clear printing step, and overcoat layer forming step, an image including a person's photograph is printed on this card.

FIG. 3A shows a print image used in the color printing step. In this example, a color data image is used as the print image. In this case, the color data image refers to an image having color and gradation values as its pixel values. The print image may be a full color image. In this example, the print image is an image greater in actual size than the card used as the medium 50. The print image is specifically an image of 91.5 mm×60 mm in actual size, as illustrated in FIG. 3A.

For convenience of illustration, FIG. 3A shows a gray-scaled image as the print image. The print image usable in this example may include a color image printed with the C, M, Y, and K inks.

FIG. 3B shows an inverted, gray-scaled image usable in the non-colored region clear printing step. In this example, the inverted, gray-scaled image is a gray-scaled and gradation-inverted image of the print image illustrated in FIG. 3A. This image can be obtained by using image processing software such as Photoshop (registered trademark) supplied by Adobe Systems Incorporated. In this example, the inverted, gray-scaled image thus obtained has the same size as the print image.

The number of gradation levels of the inverted, gray-scaled image may preferably be the same as the print image. The number of gradation levels of the inverted, gray-scaled image may desirably be at least 3 or greater.

Figure 3C:
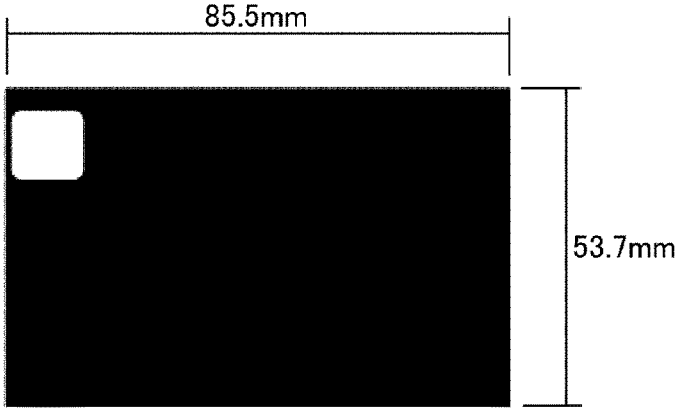

FIG. 3C shows an image usable in the overcoat layer forming step. As described referring to FIG. 2, the clear glossy printing is exercised in the overcoat layer forming step of solid print type for the substantially whole surface of the medium 50. In this example, the whole surface of the medium 50 refers to any regions but an IC chip-embedded part on the print surface of the medium 50. For the printing operation, an image based on solid print data that enables solid print by the printing device 10 (solid print image) is used in the overcoat layer forming step. Specifically, this example may form, as the solid print image, an image having a certain region painted out with a single color ink, as illustrated in FIG. 3C. The solid print image is slightly smaller in actual size than the card used as the medium 50. In this case, the solid print image may preferably be smaller in actual size than the card by less than 1% of vertical and lateral dimensions of the card. Specifically, the solid print image in this example may be an image of 85.5 mm×53.7 mm in size, as illustrated in FIG. 3C.

This example uses these images described below for the operations in the color printing step, non-colored region clear printing step, and overcoat layer forming step. In Step S102 described referring to FIG. 2, the color print image and the inverted, gray-scaled image are sequentially combined and outputted. Then, the operations in the color printing step and the non-colored region clear printing step are carried out based on the combined image.

More specifically, in this example, the C, M, Y, and K inks are discharged for printing in the color printing step, with the resolution of 720×600 (dpi) and the pass number of 8, based on the print image and by way of VD setting. The VD setting refers to setting of the ink droplets to be variable in size in multiple steps (variable dots). The VD is set in the printing device 10 for gradation printing. In the color printing step, the color ink heads 202 perform the main scans, with ultraviolet light being emitted from the ultraviolet irradiators 206.

At the same time, the UV clear ink is discharged based on the inverted, gray-scaled image in the non-colored region clear printing step. While the color ink heads 202 are performing the main scans, with ultraviolet light being emitted from the ultraviolet irradiators 206, the clear ink head 204 performs the main scans at the same time.

In this example, the color printing step and the non-colored region clear printing step simultaneously proceed. Specifically describing the simultaneity between the color printing step and the non-colored region clear printing step, the main scan by the color ink head 202 in the color printing step and the main scan by the clear ink head 204 in the non-colored region clear printing step are performed in parallel. This may allow the color printing step and the non-colored region clear printing step to proceed more efficiently. This may also achieve reduction of time required for the whole printing steps, enabling even high-speed printing.

In that case, items set for printing in the non-colored region clear printing step (for example, resolution, pass number) are the same as in the color printing step. In this example, therefore, the printing pass number is set to 8 and the resolution is set to 720×600 (dpi) by way of the VD setting in the non-colored region clear printing step. However, the ink amount to be discharged (ink droplet sizes) in the non-colored region clear printing step is set to 80% of the ink amount in the color printing step.

In this example, the UV clear ink is discharged for printing in the overcoat layer forming step, with the resolution of 720×600 (dpi) and the pass number of 4, based on the solid print image and by way of ND setting. The ND setting refers to setting of the ink droplet sizes to a predetermined size (normal dot). In this example, the clear ink head 204 performs the main scans in the overcoat layer forming step without the emission of ultraviolet light from the ultraviolet irradiators 206. Upon completion of the main scans by the clear ink head 204 at respective positions on the medium 50, scans by the ultraviolet irradiators 206 are initiated at a different timing to irradiate the ink droplets with ultraviolet light.

More specifically, in this example, the clear ink head 204 performs the main scans for the whole medium 50 without the emission of ultraviolet light from the ultraviolet irradiators 206. Then, scans by the ultraviolet irradiators 206 on the medium 50 proceed, with ultraviolet light being emitted from the ultraviolet irradiators 206. In this manner, the clear glossy printing may be favorably exercised. The overcoat layer may be accordingly favorably formed on the printed image.

In this example, the intensity of ultraviolet light emitted in the overcoat layer forming step may be weakened as compared to the light intensities set in the color printing step and the non-colored region clear printing step. During the emission of ultraviolet light, the table 20 may be slightly moved downward, so that the ultraviolet irradiators 206 and the medium 50 are more spaced apart than during the ink droplet discharge. Then, the clear glossy printing may be more favorably exercised.

In this example, the printing pass number in the overcoat layer forming step is fewer than in the color printing step, because solid print of the UV clear ink in this step does not necessitate a large pass number. This may favorably reduce time required to form the overcoat layer.

As described so far, this example may favorably form the overcoat layer on the print image printed on the medium 50. The operation in the non-colored region clear printing step may more effectively prevent unevenness of the overcoat layer than in the case of simply forming the overcoat layer on the print image.

The operations in the color printing step, non-colored region clear printing step, and overcoat layer forming step were so far described in detail referring to the specific examples of the printing conditions. The specific printing conditions, however, may be changed as needed depending on the performance of the printing device and/or demanded printing accuracy. The resolution and the pass number for printing may be changed as needed in connection with the specific operations described thus far and hereinafter described. For example, the pass number may be a greater number, for example, 32.

The operations in the color printing step and the non-colored region clear printing step may proceed simultaneously or independently depending on the set printing conditions. In case the color printing step and the non-colored region clear printing step proceed simultaneously, a combined image of the print image and the inverted, gray-scaled image may be printed (composite printing). In case the color printing step and the non-colored region clear printing step proceed independently, the print image and the inverted, gray-scaled image, without being combined, may be separately printed (non-composite printing). It is optionally decided regardless of the printing conditions which one of the operations in the color printing step and the non-colored region clear printing step is carried out earlier or later than the other. Either one of the operations may optionally precede or follow the other.

In the example described so far, the UV clear ink is cured matte in the non-colored region clear printing step, because the operations in the color printing step and the non-colored region clear printing step proceed simultaneously. This may improve the adhesion of the UV clear ink layer to the overcoat layer formed thereon. Depending on the printing conditions, the UV clear ink may be cured glossy in the non-colored region clear printing step. As a result, any colored ink-unapplied region may be more uniformly smoothed with the UV clear ink.

Next, the ability to prevent unevenness of the overcoat layer provided by this example is hereinafter described in further detail. In case of using an ink of ultraviolet curing type for printing, the ink is conventionally cured in a certain thickness. When, for example, the print image is simply printed on the medium 50, the print surface of the medium 50 may have irregularity resulting from the thickness of the color ink layer.

Such irregularity on the surface may lead to unevenness of the overcoat layer formed thereon, degrading the quality of a print matter. The overcoat layer unevenly formed may produce transverse streaks. The unevenness of the overcoat layer may incur the problems of cracks and air bubbles. The cured clear ink may undergo striped patterns, which may impair the glossiness of the clear ink layer.

When a flat plastic card is used as the medium 50 as described in this example, irregularity substantially equal to the ink layer thickness, if generated on its flat surface, may be even more noticeable. This may involve the risk of the uncured UV clear ink flowing out at the time of forming the overcoat layer. When a plastic card is used as the medium 50, such irregularity may increase repellency of any thinner ink-printed parts against the UV clear ink, possibly leaving puddles of the UV clear ink.

In case of exercising the non-colored region clear printing step as described in this example, any colored ink-unapplied regions (regions where CMYK inks for image printing are not applied) on the print surface of the medium 50 may be adequately filled with the UV clear ink. This may more effectively suppress irregularity between the colored ink-applied region and the colored ink-unapplied region. By forming the overcoat layer on the surface thus improved in smoothness, the cured overcoat layer may be suppressed from forming unevenness. This may prevent unevenness, if any, of the overcoat layer from degrading the quality of a printed matter. As a result, the overcoat layer may be formed in a more appropriate manner.

In case the print image is a photograph as described in this example, the print image may have gradations that differ at different positions. Specifically, assuming that the print image is a subject's photograph having black and white portions, these parts greatly differ from each other in gradation. When the print image is printed by inkjet printing, the ink deposited on the medium 50 may be variable in thickness due to the different gradations. Then, the ink layer thickness within the print image possibly leads to irregularity due to the different gradations.

In this example providing the non-colored region clear printing step in which the inverted, gray-scaled image is used, the UV clear ink may be discharged in an amount suited to the gradation of each pixel of the inverted, gray-scaled image at any position overlapping with the print image. According to this configuration, the UV clear ink may be applied in the non-colored region clear printing step in a manner suited to the distribution of gradations within the print image. In case of any irregularity due to the different gradations within the print image, such irregularity may be effectively suppressed in the non-colored region clear printing step. As a result, the overcoat layer may be formed in a more appropriate manner.

Figure 4A:
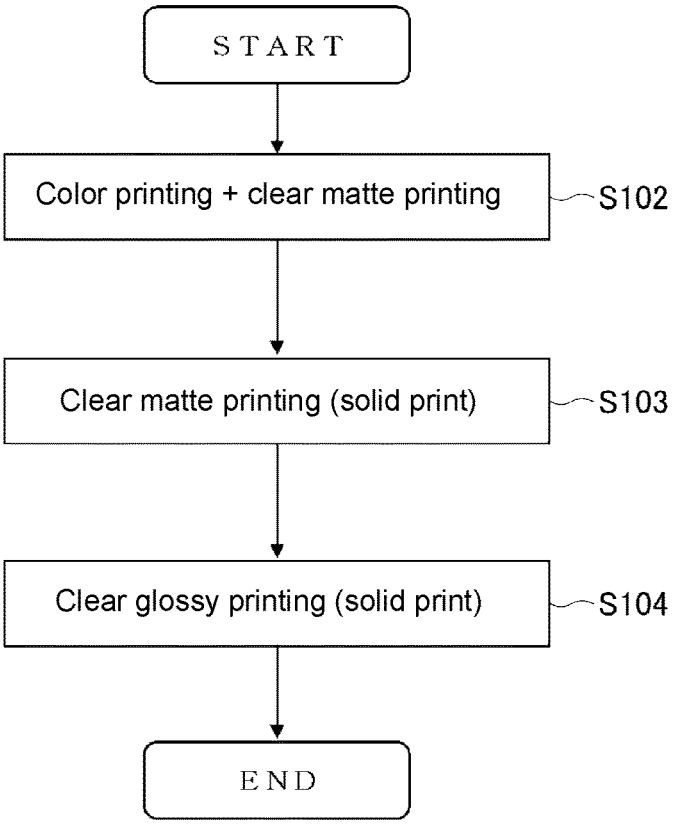
FIGS. 4A and 4B are drawings of a modified embodiment of the printing method.
Figure 4B:
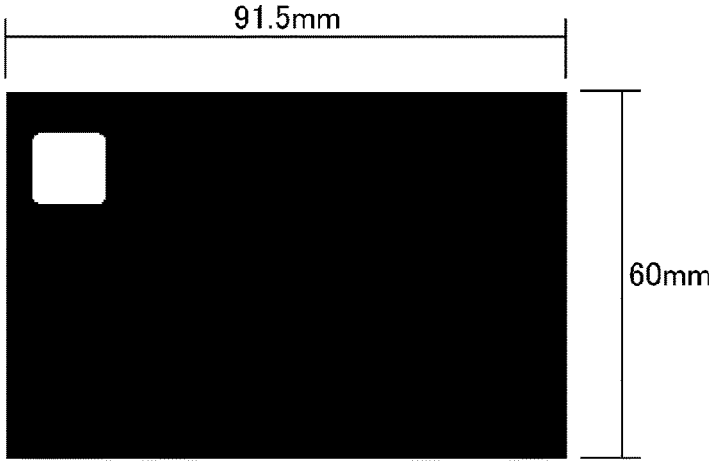

Next is described a modified embodiment of the printing method disclosed herein different from the embodiment described referring to FIGS. 1A to 3C. FIG. 4A and 4B are drawings of a modified embodiment of the printing method. FIG. 4A is a flow chart of a printing operation according to the modified embodiment.

Except for the points hereinafter described, the printing operation according to this modified embodiment is identical or similar to the printing operation described referring to FIGS. 1A to 3C. Specifically, Steps S102 and S104 in FIG. 4A are identical or similar to Steps S102 and S104 described referring to FIG. 2 except for the points hereinafter described. The printing operation in this modified embodiment may be carried out by the printing device 10 described referring to FIG. 1A.

Similarly to the description referring to FIG. 2, the printing operation in this modified embodiment includes color printing using the C, M, Y, and K inks, and clear matte printing for matte printing of the UV clear ink (Step S102). In this modified embodiment, the printing operation including the color printing step and the non-colored region clear printing step is exercised.

Then, the clear matte printing for matte printing of the UV clear ink is exercised (Step S103). Step S103 is an exemplified step including the matte clear printing step. This step exercises clear matte printing of solid print type for the whole surface of the medium 50. The matte clear printing step is a step subsequent to the non-colored region clear printing step. In this step, a region covering at least the print image printed in the color printing step is painted out with the UV clear ink, and the UV clear ink is cured matte. In the matte clear printing step of this modified embodiment, the ink droplets are discharged from the clear ink head 204 to the whole surface of the medium 50, and the discharged ink droplets are irradiated with ultraviolet light emitted from the ultraviolet irradiators 206. By having the clear ink head 204 perform the main scans, with ultraviolet light being emitted from the ultraviolet irradiators 206, the UV clear ink is cured matte.

In this modified embodiment, Step S104 is exercised subsequent to Step S103. In this step, the operation in the overcoat layer forming step follows the operation in the matte clear printing step. In the overcoat layer forming step, the overcoat layer is formed on the UV clear ink cured matte in the matte clear printing step.

In case the overcoat layer forming step immediately follows the non-colored region clear printing step, with the matte clear printing step having been skipped, the base of the overcoat layer includes the colored ink (CMYK ink) layer formed in the color printing step and the UV clear ink layer formed in the non-colored region clear printing step. The colored ink and the UV clear ink respectively have different properties. Such differences in properties may differently affect a relationship between the overcoat layer and its base at different positions. This may result in a degraded printing quality depending on the ink properties and demanded printing accuracy.

More specifically, for example, the colored ink contains a coloring material such as pigment, whereas the UV clear ink contains no coloring material. Spreading the UV clear ink containing no coloring material on the pigment-containing colored ink may produce different impacts on the UV clear ink. For example, repellency against the UV clear ink may be mentioned. As a result of such different degrees of repellency, the UV clear ink may be unequally spread.

In this modified embodiment, the matte-cured UV clear ink layer is formed in the matte clear printing step as the base of the overcoat layer. This may provide the base of the overcoat layer improved in uniformness. Then, the overcoat layer may be even more favorably formed.

Depending on the properties of inks to be used and/or demanded printing quality, the overcoat layer may be favorably formed without the matte clear printing step. In that case, the overcoat layer forming step may immediately follow the non-colored region clear printing step, with the matte clear printing step having been skipped, as described referring to FIG. 2. According to this configuration, the overcoat layer may be favorably formed by the printing operation thus simplified.

In this modified embodiment, the overcoat layer is laid on the UV clear ink layer formed on the whole surface of the medium 50 in the matte clear printing step. This means that any region where the overcoat layer is formed has two layers of the UV clear ink.

After a certain region is painted out with an ink of ultraviolet curing type, an edge part of the region may be slightly swollen after being cured. When the matte UV clear ink layer is formed in the matte clear printing step, for example, the relevant region may likewise have an edge part slightly swollen. When the overcoat layer is formed in exactly the same region as the matte UV clear ink layer, their overlapping edge parts may be further swollen. This may more adversely affect the overcoat layer. Specifically, the UV clear ink layer may increase in thickness in its edge part, easily undergoing cracks.

In this modified embodiment, therefore, a region painted out in the overcoat layer forming step may preferably be smaller than a region painted out in the matte clear printing step. Specifically, a first region covering at least the print image, for example, is painted out with the UV clear ink in the matte clear printing step. In the overcoat layer Ruining step, a second region narrower than the first region and having an edge part located within the first region is painted out with the UV clear ink. The second region may be slightly thinner in its edge part than the first region.

This may successfully avoid overlap between the edge parts of the matte UV clear ink layer and the overcoat layer, consequently preventing the edge parts of these layers from overly swelling. As a result, the overcoat layer may be formed in a more appropriate manner.

FIG. 4B shows an image used in a matte clear printing step. In the matte clear printing step of this modified embodiment, clear matte printing of solid print type is carried out for the whole surface of the medium 50. For solid print, a solid print image is used in the matte clear printing step similarly to the overcoat layer forming step.

The solid print image used in the matte clear printing step, however, is greater in actual size than the card used as the medium 50, unlike the solid print image used in the overcoat layer forming step. Specifically, a solid print image having the same size as the print image may be used in case the operations in the color printing step, non-colored region clear printing step, and overcoat layer forming step are carried out under the same conditions as in the example described referring to FIG. 3A to 3C. In this case, the solid print image is an image having the size of 91.5 mm×60 mm, as illustrated in FIG. 4B.

In this example, the UV clear ink is discharged for printing in the matte clear printing step, with the resolution of 720×600 (dpi) and the pass number of 8, based on the solid print image and by way of the VD setting. Further, for matte printing, the clear ink head 204 performs the main scans, with ultraviolet light being emitted from the ultraviolet irradiators 206. The intensity of ultraviolet light is set to a weaker intensity than in the color printing step and the non-colored region clear printing step, for example, approximately 80% of the light intensities in these steps. According to this configuration, the clear matte printing of solid print type may be appropriately exercised for the region constituting the base of the overcoat layer. Further, the base of the overcoat layer may be favorably improved in uniformness. By thus uniformizing the base, the overcoat layer may be even more favorably formed.

To uniformize the base of the overcoat layer, it may be a possible option to form the glossy-cured UV clear ink layer instead of the matte-cured UV clear ink layer. The glossy-cured UV clear ink layer, if formed as the underlayer of the overcoat layer, may undermine the adhesion between the underlayer and the overcoat layer. The risk of poor adhesion may lead to the failure to form the overcoat layer as expected.

To increase the adhesion between the underlayer and the overcoat layer, it may be a possible option to tack-dry (tentatively cure) the UV clear ink to form an underlayer. The "tack-dry" refers to a state of the ink rendered gelatinous by curing to impart viscosity to the ink dot surfaces.

The UV clear ink forming the underlayer, if tack-dried, may have poor resistance against solvents (solvent resistance) as compared to the same ink fully cured. Then, the tack-dry underlayer may be degenerated under the influences of a solvent(s) contained in the UV clear ink forming the overcoat layer. This may lead to the failure to form the overcoat layer as expected.

On the other hand, this modified embodiment, by way of matte curing of the UV clear ink forming the underlayer, imparts an adequate adhesion to the overcoat layer. Curing the UV clear ink adequately and sufficiently may effectively prevent the underlayer from degenerating. Then, the overcoat layer may be even more favorably formed.

Another modified embodiment of the printing method disclosed herein is hereinafter described. In the printing operation described referring to FIGS. 1A to 4B, the color printing step and the non-colored region clear printing step proceed simultaneously. In another modified embodiment of the printing operation, the color printing step and the non-colored region clear printing step may not necessarily proceed simultaneously but may be handled as separate steps. In that case, the color printing step may precede the other step for the whole surface of the medium 50. After the whole print image is printed, the clear matte printing is exercised in the non-colored region clear printing step. In this manner, the operations in the color printing step and the non-colored region clear printing step may be appropriately carried out. Subsequent to these steps, the operations in the matte clear printing step and the overcoat layer forming step may be favorably carried out, and the overcoat layer may be accordingly favorably formed.

As for the emission of ultraviolet light in the overcoat layer forming step, the whole medium 50 may be irradiated with ultraviolet light at once, instead of scans by the ultraviolet irradiators 206. In that case, an ultraviolet light source different from the ultraviolet irradiators 206 may be used. Specifically, after the ink droplets of the UV clear ink are discharged, the whole medium 50 may be irradiated with ultraviolet light emitted from a powerful light source such as a UV lamp after the passage of adequate time. This may more adequately improve the overcoat layer in smoothness.

Figure 5A:
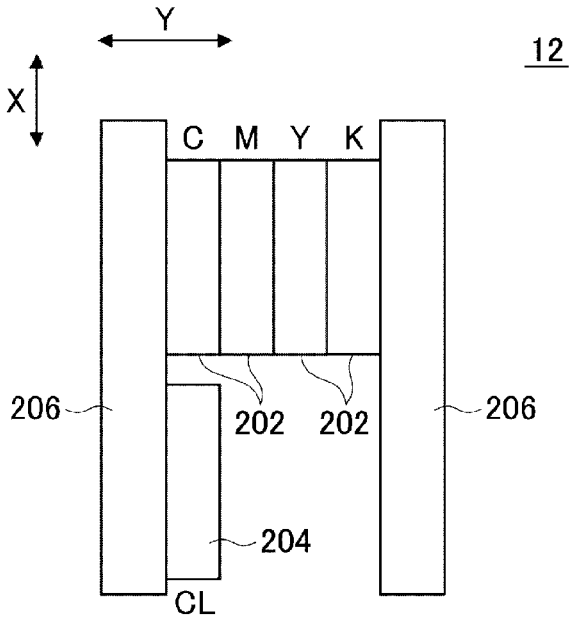
FIG. 5A and 5B are drawings of another modified embodiment of the printing method.
Figure 5B:
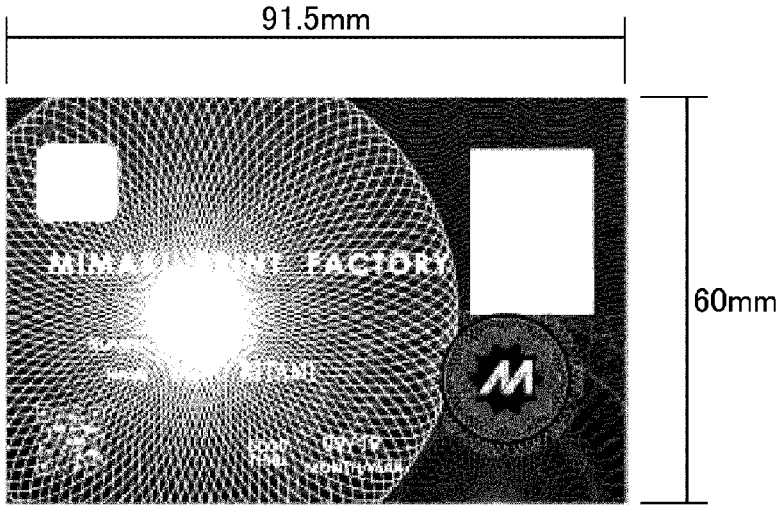

There may be modified examples of the head unit 12 and the image usable in the non-colored region clear printing step. These modified examples are hereinafter described. FIG. 5A and 5B are drawings of another modified embodiment of the printing method. FIG. 5A is a drawing of a modified example of the head unit 12.

As described earlier in connection with FIG. 1A, a head unit 12 structured differently from the head unit 12 of FIG. 1B may be used. For example, the clear ink head 204 may be positionally displaced from the color ink heads 202 in the sub scanning direction, as illustrated in FIG. 5A.

According to this configuration, the operations in the color printing step, non-colored region clear printing step, matte clear printing step, and overcoat layer forming step may also be properly carried out identically or similarly to the operations described so far, and the overcoat layer may be accordingly favorably formed.

FIG. 5B shows a modified example of the image used in the non-colored region clear printing step. FIGS. 1A to 4B illustrate the operation when the inverted, gray-scaled image is used in the non-colored region clear printing step. Depending on the demanded printing accuracy and quality, a binarized image may be usable instead of the gray-scaled image. The print image is gradation-inverted and binarized based on a preset threshold to obtain an image (hereinafter, inverted, binarized image), as illustrated in FIG. 5B. This image is used in the non-colored region clear printing step instead of the inverted, gray-scaled image.

The printing conditions preferably employed to print the inverted, binarized image may differ from the printing conditions set to print the print image in the color printing step. When the inverted, binarized image is used in the non-colored region clear printing step, the operation in the non-colored region clear printing step may preferably precede or follow the operation in the color printing step in accordance with the printing conditions employed, instead of having the operations in these steps proceed simultaneously. More specifically, in case the print image and the inverted, binarized image are both printed at the same resolution, the color printing step and the non-colored region clear printing step may proceed simultaneously by printing a composite image of these images. When the print image and the inverted, binarized image are both printed at different resolutions, the color printing step and the non-colored region clear printing step proceed at different times by separately printing these images without combining them.

It is assumed that, in the operation illustrated in FIGS. 5A and 5B, the color printing step proceeds under the printing conditions described referring to FIGs. 3A to 3C. Then, in the non-colored region clear printing step using the inverted, binarized image, the UV clear ink may be discharged for printing, with the resolution of 720×600 (dpi) and the pass number of 4, by way of the ND setting. Further, for matte printing, the clear ink head 204 performs the main scans, with ultraviolet light being emitted from the ultraviolet irradiators 206. In this case, the intensity of ultraviolet light then may be set to be the same as the ultraviolet light intensity in the color printing step (100%). This may more effectively suppress irregularity between the colored (CMYK) ink-applied region and the colored ink-unapplied region in accordance with the demanded printing accuracy and quality. By forming the overcoat layer on the surface thus improved in smoothness, the cured overcoat layer may be suppressed from forming unevenness.

So far was described the operation in the non-colored region clear printing step using the UV clear ink to prevent the overcoat layer from becoming uneven after being cured. The inks usable to prevent unevenness of the overcoat layer after being cured are not necessarily limited to the UV inks, and other color inks may be used. Such modified examples of the inks are hereinafter described.

Figure 6A:
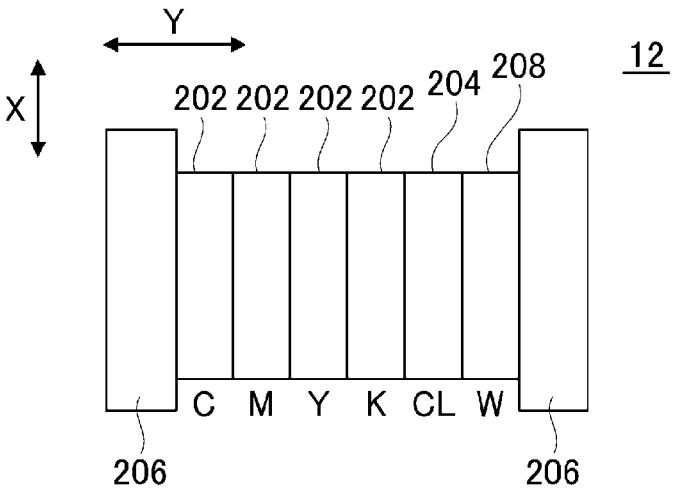
FIG. 6A and 6B are drawings of examples of the head unit 12 used in the printing method according to the modified embodiment.
Figure 6B:
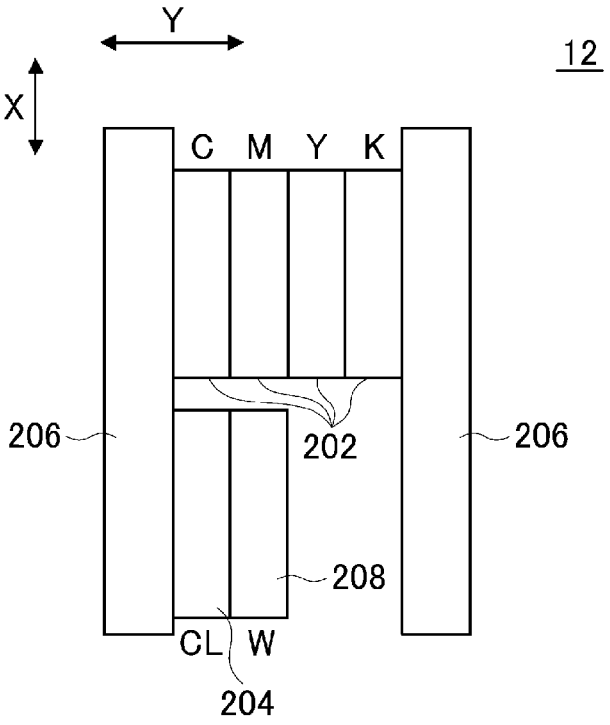
Figure 7:
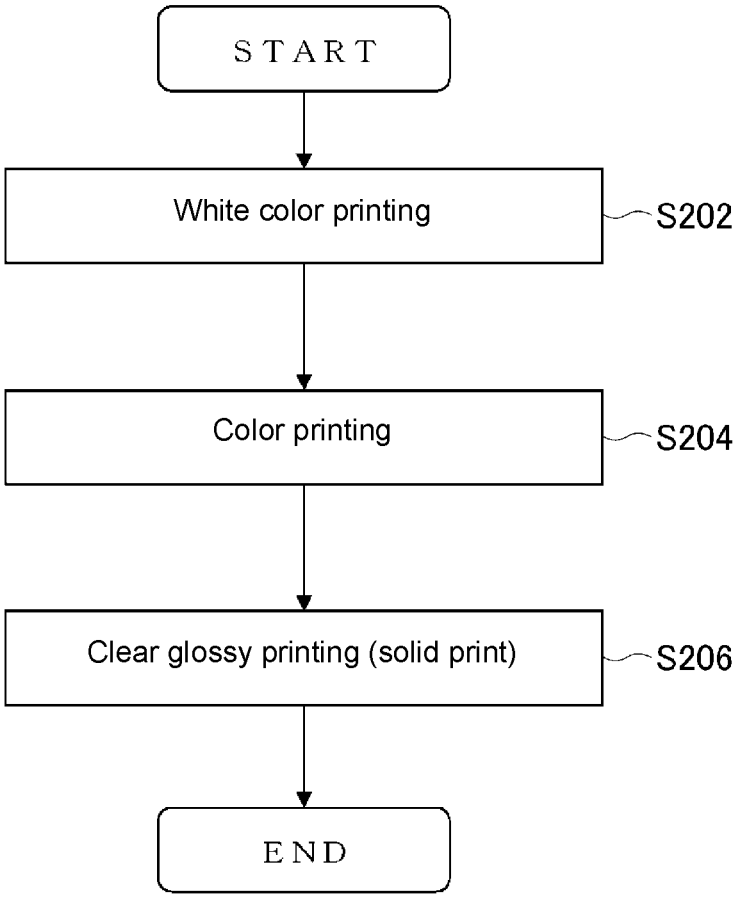
FIG. 7 is a flow chart of the printing operation according to the modified embodiment.

FIGS. 6A, 6B and 7 are drawings of yet another modified embodiment of the printing method. Except for the points hereinafter described, the printing method according to this modified embodiment is identical or similar to the printing operation described referring to FIGS. 1A to 5B.

FIG. 6A and 6B are drawings of examples of the head unit 12 usable in the printing method according to this modified embodiment. FIG. 6A is a drawing of an example of the head unit 12. FIG. 6B is a drawing of another example of the head unit 12. Except for the additional features described below, the structural elements illustrated in FIG. 6A and 6B with the same reference signs as in FIGS. 1A to 5B are identical or similar to the ones illustrated in FIGS. 1A to 5B. The head unit 12 may be used in a printing device identical or similar to the printing device 10 illustrated in FIG. 1A.

In the illustration of FIG. 6A, the head unit 12 has a white ink head 208 in addition to the head unit 12 illustrated in FIG. 1B. The white ink head 208, the clear ink head 204, and the color ink heads 202 are arranged in a row in the main scanning direction (Y direction). The white ink head 208 is in positional alignment with these color and clear ink heads in the sub scanning direction (X direction).

In the illustration of FIG. 6B, the head unit 12 has a white ink head 208 in addition to the head unit 12 illustrated in FIG. 5A. The white ink head 208 is disposed next to the clear ink head 204 in the main scanning direction in positional alignment with he clear ink head 204 in the sub scanning direction (X direction).

In this modified embodiment, the white ink head 208 is an example of the predetermined color ink head as an inkjet head that discharges ink droplets of the predetermined color ink of ultraviolet curing type having a predetermined color. This white ink head 208 discharges ink droplets of a white ink as an example of the predetermined color ink. Except for any other aspects but the ink to be used, the white ink head 208 may have a feature identical or similar to the color ink heads 202 and the clear ink head 204. The white ink head 208, for example, has a nozzle array in which a plurality of nozzles are arranged in the sub scanning direction (X direction). The head unit 12 thus characterized in this modified embodiment discharges the ink droplets of the C, M, Y, and K inks from the color ink heads 202, discharges the ink droplets of the UV clear ink from the clear ink head 204, and discharges the ink droplets of the white ink from the white ink head 208.

In this modified embodiment, as described earlier, the white ink head 208 is an example of the predetermined color ink head. In a further modified embodiment, the predetermined color ink head may be an inkjet head that discharges the ink droplets of any predetermined color but white. In case the print surface of the target medium 50 is of any color but white, the predetermined color ink may be the same as the color of the print surface of the medium 50. The predetermined color ink may be selected from inks of various colors that constitute the background of the print image. The head unit 12 may not necessarily be configured as described so far.

In the printing method described referring to FIGS. 1A to 5B, dented parts of the print image are leveled out with the UV clear ink to avoid irregularity of the region constituting the base of the overcoat layer. This may effectively suppress unevenness of the overcoat layer formed on the base, improving the overcoat layer in smoothness.

In the modified embodiment, the white ink, instead of the UV clear ink, is used to level out dented parts of the print image. Next, the printing method in this modified embodiment is hereinafter described in further detail.

FIG. 7 is a flow chart of the printing operation according to the modified embodiment. Except for the points hereinafter described, the printing operation according to this modified embodiment is identical or similar to the printing operation described referring to FIGS. 1A to 5B.

In the printing operation of this modified embodiment, the white ink is discharged from the white ink head 208 before the print image is printed with the inks discharged from the color ink heads 202 (Step S202). Step S202 is an exemplified step including the predetermined color printing step. More specifically, in Step S202, the ink droplets are discharged from the white ink head 208 to at least a partial region on the print surface of the medium 50, and the partial region is irradiated with ultraviolet light emitted from the ultraviolet irradiators 206.

Except for the ink used, the printing operation using the white ink head 208 in Step S202 may be identical or similar to the printing operation using the clear ink head 204 in Step S102 illustrated in FIG. 2. More specifically, in Step S202, the white ink head 208 discharges the ink droplets based on a gradation-inverted, gray-scaled image of the print image. Thus, the inverted, gray-scaled image is printed with the white ink. Generalizing Step S202, the white ink head 208 discharges the white ink for printing to at least a non-colored region in which the ink droplets of the C, M, Y, and K inks are not discharged in Step S204 performed later. The white ink head 208 discharges the ink droplets of the white ink into dented parts of the uneven print image printed with the C, M, Y, and K inks alone. Thus, dented parts of the uneven print image printed with the C, M, Y, and K inks alone are filled with the white ink discharged.

In the printing operation of this modified embodiment, color printing is then performed using the C, M, Y, and K inks discharged from the color ink heads 202 (Step S204). Step S204 is an exemplified step including the color printing step. More specifically, in Step S204, the ink droplets are discharged from the color ink heads 202 to at least a partial region on the print surface of the medium 50, and the partial region is irradiated with ultraviolet light emitted from the ultraviolet irradiators 206. Thus, the print image is printed on the medium 50 with the C, M, Y, and K inks. The printing operation using the color ink heads 202 in Step S204 may be identical or similar to the printing operation using the color ink heads 202 in Step S102 illustrated in FIG. 2.

The printing operation of this modified embodiment performs clear glossy printing using the UV clear ink discharged from the clear ink head 204 to form the overcoat layer (Step S206). Step S206 is an exemplified step including the overcoat layer forming step. Specifically, in Step S206, the ink droplets are discharged from the clear ink head 204 to a region covering at least the print image printed in Step S204, and the region is irradiated with ultraviolet light emitted from the ultraviolet irradiators 206. Thus, the overcoat layer that covers the print image is formed with the UV clear ink. The printing operation using the clear ink head 204 in Step S206 may be identical or similar to the printing operation using the clear ink head 204 in Step S104 illustrated in FIG. 2.

In this modified embodiment, Step S202 prints the inverted, gray-scaled image using the white ink head 208. Step S204 subsequent to this step prints the print image using the color ink heads 202. In this manner, any dented parts of the print image in the CMYK ink-unapplied region on the medium 50 may be adequately filled with the white ink. Step S202 of the printing operation based on the inverted, gray-scaled image may allow the white ink amount to be adjusted depending on the amounts of C, M, Y, and K inks discharged at respective positions on the medium 50. This modified embodiment may more effectively suppress irregularity between the CMYK ink-applied region and the CMYK ink-unapplied region. This may also effectively suppress unevenness of the overcoat layer, improving the overcoat layer in smoothness. By using the white ink as described in this modified embodiment, the non-colored region may be adequately filled with this ink without the risk of unintentionally coloring the peripheral region of the print image. In this modified embodiment, the overcoat layer may be more favorably formed.

When, for example, the colorless and transparent UV clear ink used to fill the dented parts of the print image is discharged on the print image, the visibility of the print image is not affected, as described referring to FIGS. 1A to 5B. In case of discharging the white ink, instead of the colorless and transparent ink, on the print image to fill the dented parts of the print image as described in this modified embodiment, the white ink applied on the print image may overlap with the print image to impair the visibility of the print image. This may degrade the quality of the print image.

In case of using any ink but colorless, transparent inks to fill the dented parts of the print image, the white ink may preferably be discharged to fill such parts before the print image is printed with the C, M, Y, and K inks, as illustrated in FIG. 7. This may effectively prevent the quality of the print image from degrading.

The printing operation of this modified embodiment may be further modified as described in connection with FIGS. 1A to 5B. In this modified embodiment, the clear matte printing may be performed before the overcoat layer is formed similarly to Step S103 illustrated in FIG. 4A. In that case, the matte printing using the clear ink head 204 may be exercised between Steps S204 and S206 of FIG. 7 similarly to Step S103 illustrated in FIG. 4A. This may more adequately improve the overcoat layer in smoothness.

Thus far was described the embodiments of this invention. However, the technical scope of this invention is not necessarily limited to the described embodiments. Those skilled in the art should obviously understand that the embodiments may be subject to various changes and/or improvements. As is clearly understood from the appended claims, it should be understood that such changes and/or improvements are included in the technical scope of this invention.

INDUSTRIAL APPLICABILITY

The technology disclosed herein may be suitably applicable to printing methods.

The invention claimed is:

1. A printing method that carries out an inkjet printing operation for a print surface of a medium as a print target, the printing method comprising use of:

a colored ink head as an inkjet head that discharges ink droplets of a colored ink of ultraviolet curing type;

a clear ink head as an inkjet head that discharges ink droplets of a UV clear ink of ultraviolet curing type having a clear color; and an ultraviolet irradiator that emits ultraviolet light, the printing method further comprising:

a color printing step of having the colored ink head discharge the ink droplets to at least a partial region on the print surface of the medium based on a print image as an image to be printed and having the ultraviolet irradiator emit ultraviolet light to the partial region to print the print image using the colored ink;

a non-colored region clear printing step of having the clear ink head discharge the ink droplets and having the ultraviolet irradiator emit ultraviolet light to apply the UV clear ink to a region at least including a non-colored region on the print surface of the medium, the non-colored region being a region in which the ink droplets are not discharged in the color printing step; and an overcoat layer forming step that follows the non-colored region clear printing step, the overcoat layer forming step being a step of having the clear ink head discharge the ink droplets to a region covering at least the print image printed in the color printing step and having the ultraviolet irradiator emit ultraviolet light to the region to form an overcoat layer that covers the print image using the UV clear ink, wherein in the non-colored region clear printing step, the ink droplets are discharged from the clear ink head based on a gray-scaled and gradation-inverted image of the print image.

2. The printing method as set forth in claim 1, wherein in the overcoat layer forming step, a region preconfigured to cover at least the print image is painted out with the UV clear ink.

3. The printing method as set forth in claim 1, wherein the UV clear ink is cured matte in the non-colored region clear printing step, and the UV clear ink is cured glossy in the overcoat layer forming step.

4. The printing method as set forth in claim 1, wherein the colored ink head and the clear ink head perform a main scan and a sub scan for the inkjet printing operation for the medium, the main scan being a scan in which the colored ink head and the clear ink head, while moving in a predetermined main scanning direction, discharge the ink droplets, the sub scan being a scan in which the colored ink head and the clear ink head move relative to the medium in a sub scanning direction orthogonal to the main scanning direction, the main scan by the colored ink head in the color printing step and the main scan by the clear ink head in the non-colored region clear printing step proceed in parallel.

5. The printing method as set forth in claim 1, wherein the medium is a plastic card.

6. A printing device that performs an inkjet printing operation using the printing method as set forth in claim 1.

7. A printing method that carries out an inkjet printing operation for a print surface of a medium as a print target, the printing method comprising use of:

a colored ink head as an inkjet head that discharges ink droplets of a colored ink of ultraviolet curing type;

a clear ink head as an inkjet head that discharges ink droplets of a UV clear ink of ultraviolet curing type having a clear color; and an ultraviolet irradiator that emits ultraviolet light, the printing method further comprising:

a color printing step of having the colored ink head discharge the ink droplets to at least a partial region on the print surface of the medium based on a print image as an image to be printed and having the ultraviolet irradiator emit ultraviolet light to the partial region to print the print image using the colored ink;

a non-colored region clear printing step of having the clear ink head discharge the ink droplets and having the ultraviolet irradiator emit ultraviolet light to apply the UV clear ink to a region at least including a non-colored region on the print surface of the medium, the non-colored region being a region in which the ink droplets are not discharged in the color printing step; and an overcoat layer forming step that follows the non-colored region clear printing step, the overcoat layer forming step being a step of having the clear ink head discharge the ink droplets to a region covering at least the print image printed in the color printing step and having the ultraviolet irradiator emit ultraviolet light to the region to form an overcoat layer that covers the print image using the UV clear ink;

the printing method further comprising a matte clear printing step subsequent to the non-colored region clear printing step, wherein in the matte clear printing step, a region covering at least the print image printed in the color printing step is painted out with the UV clear ink, and the UV clear is cured matte, and in the overcoat layer forming step, the overcoat layer is formed on the UV clear ink cured matte in the matte clear printing step.

8. The printing method as set forth in claim 7, wherein in the matte clear printing step, a first region that covers at least the print mage is painted out with the UV clear ink, and in the overcoat layer forming step, a second region narrower than the first region and having an edge part located within the first region is painted out with the UV clear ink.

9. A printing method that carries out an inkjet printing operation for a print surface of a medium as a print target, the printing method comprising use of:

a colored ink head as an inkjet head that discharges ink droplets of a colored ink of ultraviolet curing type;

a clear ink head as an inkjet head that discharges ink droplets of a UV clear ink of ultraviolet curing type having a clear color;

a predetermined color ink head as an inkjet head that discharges ink droplets of a predetermined color ink of ultraviolet curing type having a predetermined color; and an ultraviolet irradiator that emits ultraviolet light, the printing method further comprising:

a predetermined color printing step of having the predetermined color ink head discharge the ink droplets to at least a partial region on the print surface of the medium and having the ultraviolet irradiator emit ultraviolet light to the partial region;

a color printing step of having the colored ink head discharge the ink droplets to at least a partial region on the print surface of the medium based on a print image as an image to be printed and having the ultraviolet irradiator emit ultraviolet light to the partial region to print the print image using the colored ink; and an overcoat layer forming step of having the clear ink head discharge the ink droplets to a region covering at least the print image printed in the color printing step and having the ultraviolet irradiator emit ultraviolet light to the region to form an overcoat layer that covers the print image using the UV clear ink, the predetermined color printing step further being a step of applying the predetermined color ink to a region at least including a non-colored region on the print surface of the medium, the non-colored region being a region in which the ink droplets are not discharged in the color printing step; wherein in the predetermined color printing step, the ink droplets are discharged from the predetermined color ink head based on a gray-scaled and gradation-inverted image of the print image.

10. The printing method as set forth in claim 9, wherein the predetermined color ink is applied in the predetermined color printing step prior to the color printing step.

11. A printing device that performs an inkjet printing operation using the printing method as set forth in claim 9.

12. The printing method as set forth in claim 10, wherein the predetermined color ink is a white ink.

* * * * *